US006598351B2

(12) United States Patent
Hallberg

(10) Patent No.: US 6,598,351 B2
(45) Date of Patent: Jul. 29, 2003

(54) TELESCOPIC SEATING RISER ASSEMBLY

(75) Inventor: Edwin A. Hallberg, Midland, MI (US)

(73) Assignee: Stageright Corporation, Clare, MI (US)

( * ) Notice: Subject to any disclaimer, the term of this patent is extended or adjusted under 35 U.S.C. 154(b) by 0 days.

(21) Appl. No.: 09/904,552

(22) Filed: Jul. 16, 2001

(65) Prior Publication Data

US 2003/0009950 A1 Jan. 16, 2003

(51) Int. Cl.[7] ..... E04H 3/12
(52) U.S. Cl. ..... 52/9; 52/6; 52/64; 52/741.1
(58) Field of Search ..... 52/6, 7, 8, 9, 64, 52/741.1; 297/331, 236, 257

(56) References Cited

U.S. PATENT DOCUMENTS

| | | | | |
|---|---|---|---|---|
| 3,107,398 A | | 10/1963 | Murphy | |
| 3,222,827 A | | 12/1965 | Smith | |
| 3,279,131 A | | 10/1966 | Curra | |
| 3,400,502 A | | 9/1968 | Scaggs et al. | |
| 3,488,898 A | | 1/1970 | Scaggs | |
| 3,608,251 A | | 9/1971 | Scaggs | |
| 3,667,171 A | | 6/1972 | McClelland et al. | |
| RE29,635 E | | 5/1978 | McClelland et al. | |
| 4,155,202 A | | 5/1979 | Hartman | |
| 4,446,659 A | | 5/1984 | Quigley | |
| 4,467,569 A | | 8/1984 | Blanchard et al. | |
| 4,557,080 A | | 12/1985 | Walworth et al. | |
| 4,565,036 A | | 1/1986 | Lyman, Jr. | |
| 4,638,604 A | | 1/1987 | Rogers et al. | |
| 4,843,792 A | | 7/1989 | Rogers et al. | |
| 4,845,915 A | | 7/1989 | Rogers et al. | |
| 5,050,353 A | | 9/1991 | Rogers et al. | |
| 5,317,842 A | * | 6/1994 | Rogers et al. | 403/174 |
| 5,381,873 A | * | 1/1995 | Kniefel et al. | 182/152 |
| 5,459,964 A | | 10/1995 | Doublet | |
| 5,784,835 A | | 7/1998 | McArthur, Jr. | |
| 5,820,110 A | * | 10/1998 | Beu | 182/106 |
| 6,041,554 A | | 3/2000 | McArthur, Jr. | |
| 6,212,828 B1 | * | 4/2001 | McArthur, Jr. | 52/8 |

FOREIGN PATENT DOCUMENTS

| | | | |
|---|---|---|---|
| DE | 1213591 | 3/1966 | |
| DE | 2822517 | * 12/1978 | 52/7 |
| DE | 29 27 748 | 1/1981 | |
| DE | 4212330 | * 10/1993 | 52/8 |
| EP | 316182 | * 5/1989 | 52/9 |
| EP | 0 330 838 | 6/1989 | |
| FR | 2384920 | 10/1978 | |
| FR | 2693224 | 1/1994 | |
| GB | 657978 | 10/1951 | |
| RU | 872710 | 10/1981 | |

* cited by examiner

*Primary Examiner*—Carl D. Friedman
*Assistant Examiner*—Brian E. Glessner
(74) *Attorney, Agent, or Firm*—David M. Thimmig; Mayer, Brown, Rowe & Maw

(57) ABSTRACT

A telescopic seating riser assembly capable of being configured into a variety of seating riser systems. The assembly has a plurality risers having vertically spaced substantially horizontal portions with the risers being movable between an extended position for use and a retracted position for storage. The assembly is further constructed to support deck bridging panels between spaced apart pairs of assemblies, and to utilize a method of supporting at least one deck bridging panel on a pair of spaced apart telescopic seating riser assemblies in an extended position for use and in a retracted position for storage of the assemblies.

25 Claims, 10 Drawing Sheets

TELESCOPIC SEATING RISER ASSEMBLY

BACKGROUND OF THE INVENTION

1. Field of the Invention

The present invention generally relates to portable seating equipment, and more particularly to a telescopic seating riser assembly for use in seating systems having various configurations. The telescopic seating riser assembly of the present invention comprises a plurality of risers having vertically spaced substantially horizontal portions, with the risers being movable between at least an extended position for use and a retracted position for storage. The assembly is capable of use alone or spaced apart from a similar assembly and in combination with deck bridging panels.

2. Discussion of the Prior Art

Seating risers are designed for use in auditoriums, gymnasiums, and event halls to accommodate spectators on portable seats, such as folding chairs. Depending on the intended use, a facility may require seating risers that are capable of being moved from a retracted position for storage, to an extended position for use with seating placed on top of the risers. Heretofore, many different telescopic seating riser structures have been provided to satisfy non-permanent seating riser needs. Examples of such telescopic structures can be seen in U.S. Pat. Nos. 3,400,502, 4,467,569 and 6,041,554. These prior art systems use a series of assemblies having seating risers of given heights where the seating risers are telescopically connected to store within close proximity to one another. With each of these prior art systems, several of the telescopic assemblies could be placed adjacent one another, for instance, to form the seating along a side of an athletic playing surface.

Because of the temporary nature of the seating used by some organizations and the large storage area required to house seating riser systems when not extended for use, it is desirable to have easily transportable telescopic seating riser assemblies. It also is desirable to be able to achieve a variety of seating configurations while using a common telescopic seating riser assembly throughout a seating system. It is similarly desirable to have a system that is capable of supporting deck bridging panels between each two spaced apart telescopic seating riser assemblies. In essence, if every other set of seating riser deck surfaces along the length of an entire seating system does not require a full understructure, the floor space required for storage of the seating system when not in use and the cost of the system can be reduced significantly.

It is advantageous to be able to position a telescopic seating riser assembly in front of a wall to be extended for use or retracted for storage in a given location. It is also advantageous to be able to roll extended or retracted assemblies across a flooring surface so as to form multiple seating configurations, or to bring the retracted assemblies together to minimize the total floor space required for system storage. It is still further advantageous to have a telescopic seating riser system which consists of simple, telescopic assemblies that can be extended for use or retracted for storage by unskilled persons, with minimal use of tools, and which can readily achieve a simplified, space efficient storage configuration. The present invention overcomes disadvantages of the prior art, while providing the above mentioned desirable features of a telescopic seating riser structure.

SUMMARY OF THE INVENTION

The purpose and advantages of the invention will be set forth in and apparent from the description and drawings that follow, as well as will be learned by practice of the invention.

The present invention is generally embodied in a telescopic seating riser assembly which can be configured into a variety of seating riser arrangements. In a first aspect, the invention provides a telescopic seating riser assembly comprising a plurality of risers having vertically spaced substantially horizontal portions, with the risers being movable between at least an extended position for use and a retracted position for storage. Each riser of the telescopic seating riser assembly has at least a first rear leg proximate a first rear corner of the riser and at least a second rear leg proximate a second rear corner of the riser. Each riser above a lowest riser also has at least a first front wheel proximate a first front corner of the riser and at least a second front wheel proximate a second front corner of the riser, with the front wheels contacting an upper surface of a next lower riser. Each riser also has deck bridging panel supports proximate the front and rear corners of the riser, with the deck bridging panel supports adapted to engage a deck bridging panel when a pair of riser assemblies are spaced apart substantially the length of the deck bridging panel.

In another aspect, the invention provides a telescopic seating riser assembly comprising a plurality of risers having vertically spaced substantially horizontal portions, with the risers being movable between at least an extended position for use and a retracted position for storage. Each riser further has at least one upward facing deck surface on the horizontal portion of the riser, and at least one pair of rear legs and at least one pair of ground engaging wheels proximate the rear legs. Each riser further has at least one deck bridging panel support extending outward from the horizontal portion of the riser.

In still a further aspect, the present invention provides a method of providing support for deck bridging panels in a telescopic seating riser assembly. The method comprises the steps of providing a pair of spaced apart telescopic seating riser assemblies, each assembly comprising a plurality of risers having vertically spaced substantially horizontal portions, the risers being movable between at least an extended position for use and a retracted position for storage, and wherein each riser further comprises at least one upward facing deck surface on the horizontal portion and at least one deck bridging panel support extending outward from the horizontal portion, and supporting at least one deck bridging panel by the deck bridging panel supports on the pair of spaced apart telescopic seating riser assemblies in an extended position for use and in a retracted position for storage of the assemblies.

It is to be understood that both the foregoing general description and the following detailed description are exemplary and provided for purposes of explanation only, and are not restrictive of the invention, as claimed. Further features and objects of the present invention will become more fully apparent in the following description of the preferred embodiment of this invention and from the appended claims.

BRIEF DESCRIPTION OF THE DRAWINGS

In describing the preferred embodiment, reference is made to the accompanying drawing figures wherein like parts have like reference numerals, and wherein.

It should be understood that the drawings are not to scale and that certain aspects are illustrated in phantom views. While considerable mechanical details of a telescopic seating riser assembly, including details of fastening means and other plan and section views of the particular embodiment depicting the invention have been omitted, such detail is not per se part of the present invention and is considered well within the comprehension of those skilled in the art in light of the present disclosure. It also should be understood that the present invention is not limited to the preferred embodiment illustrated.

DETAILED DESCRIPTION OF THE PREFERRED EMBODIMENT

Figure 1:
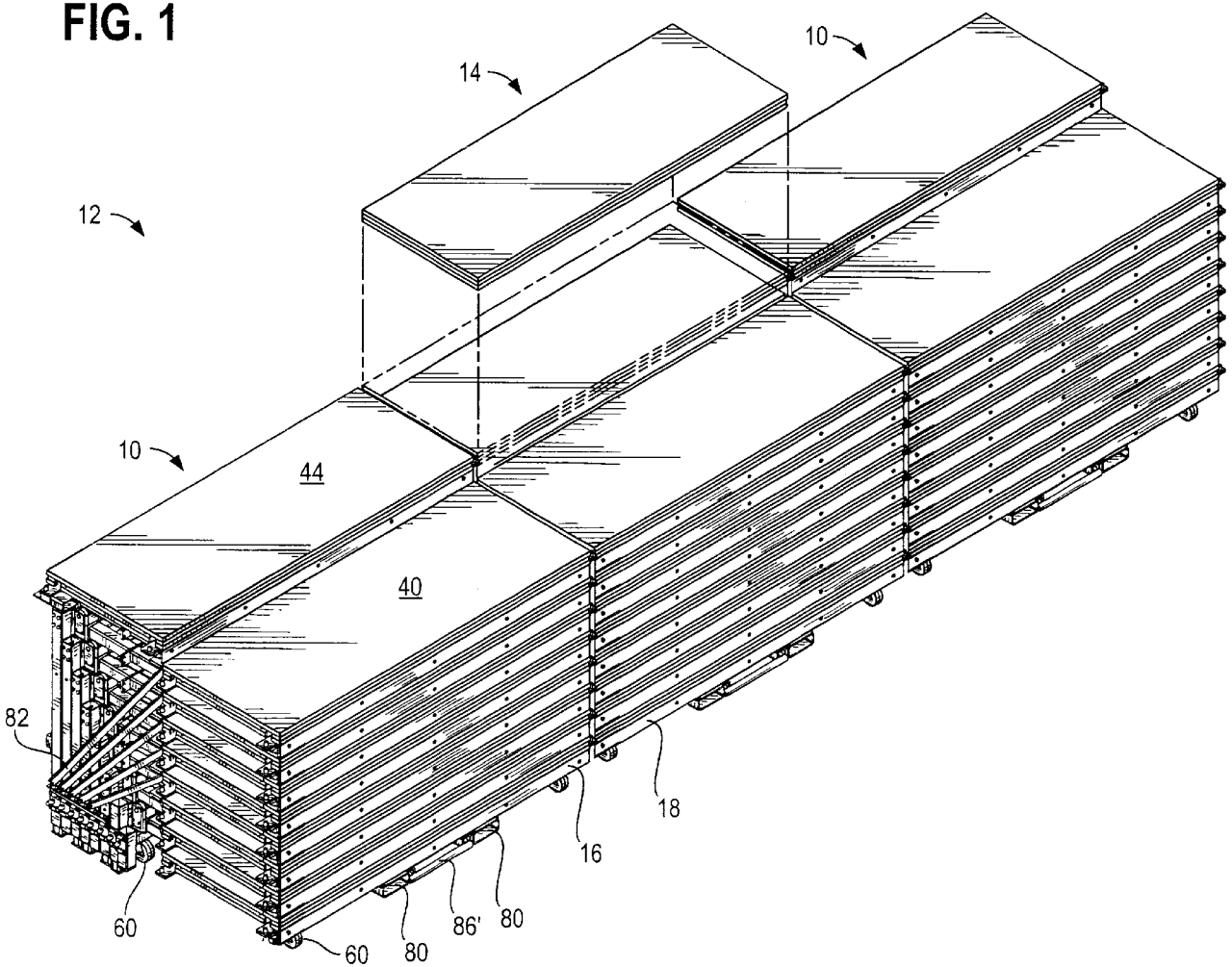
FIG. 1 is a front perspective exploded view of a pair of retracted telescopic seating riser assemblies with a series of deck bridging panels spanning the space between the two assemblies.
Figure 5:
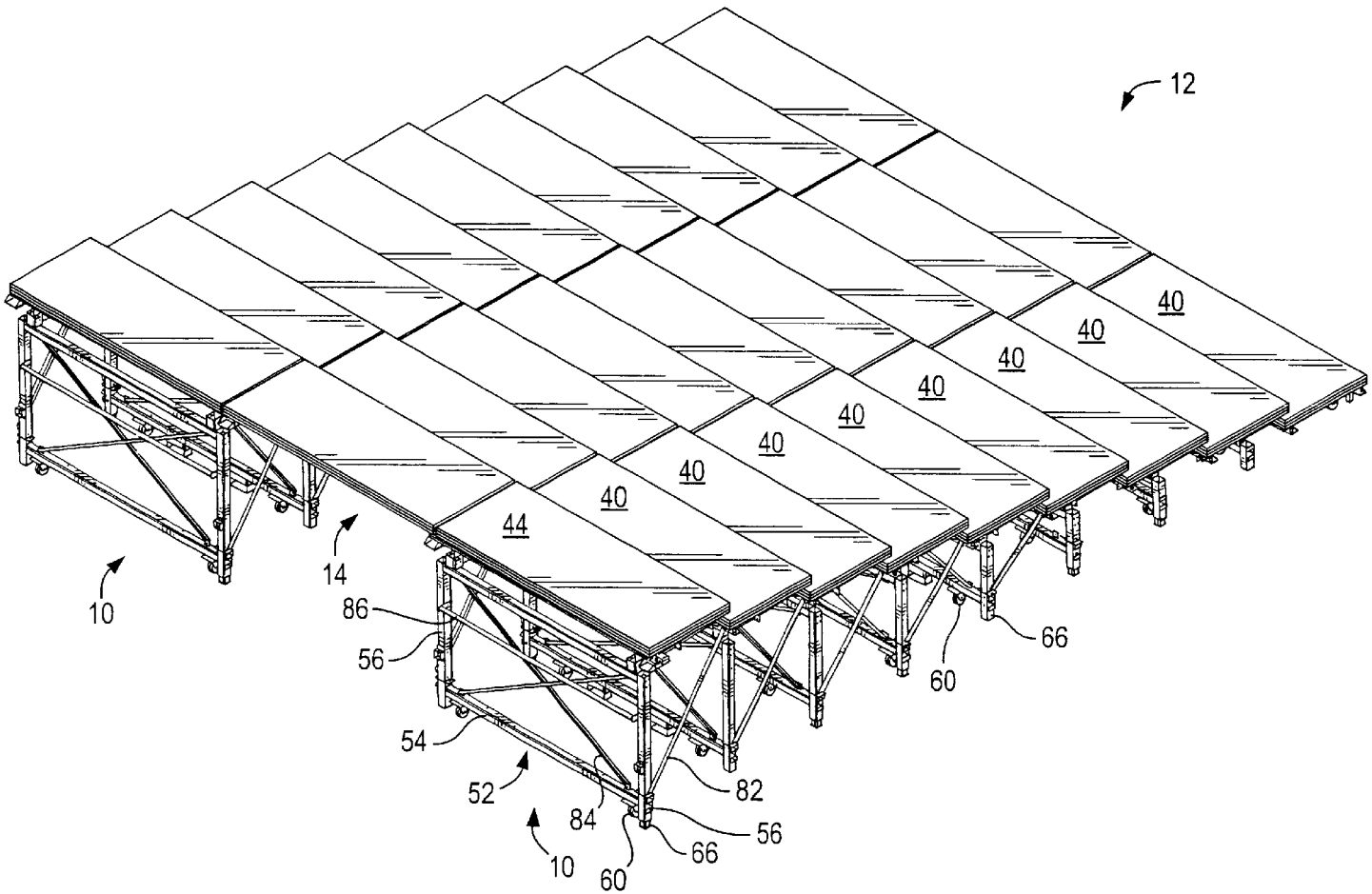
FIG. 5 is a rear perspective view of a pair of extended telescopic seating riser assemblies with a series of deck bridging panels spanning the space between the two assemblies.
Figure 6:
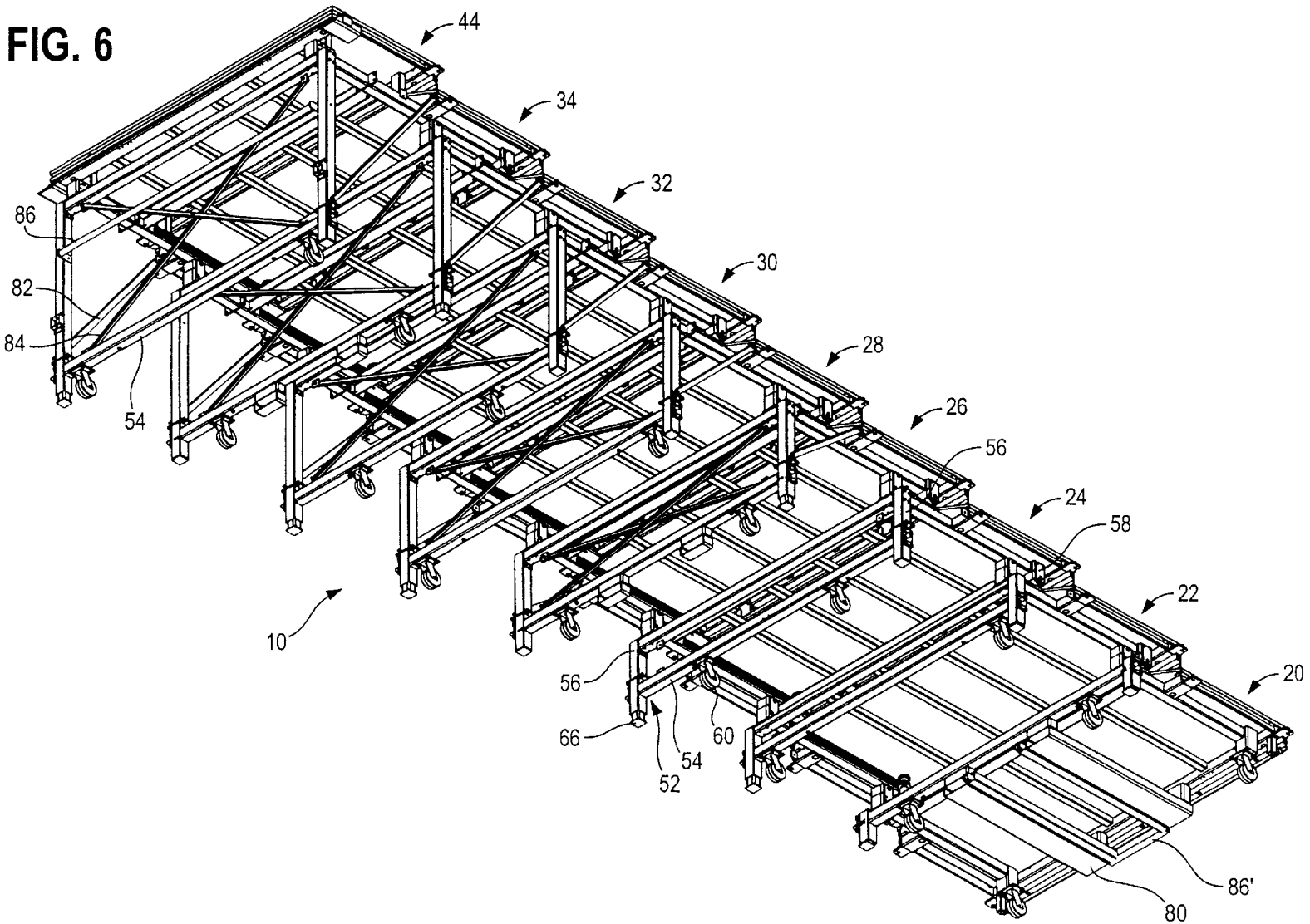
FIG. 6 is a bottom perspective view of an extended telescopic seating riser assembly.

Referring generally to FIGS. 1–8, it will be appreciated that the telescopic seating riser assemblies 10 of the present invention generally may be embodied in numerous configurations of a telescopic seating riser system 12. Telescopic seating riser assemblies 10 form the fundamental building blocks of the system 12. The assemblies 10 may stand alone, or may stand side by side. However, as seen in FIGS. 1 and 5, like telescopic seating riser assemblies 10 are intended to be arranged in a spaced apart configuration to support deck bridging panels 14 therebetween.

Use of deck bridging panels 14 provides significant savings in cost and storage space by reducing the number of full telescopic seating riser assemblies 10 needed to provide a required total riser surface area within a full seating system. For instance, the telescopic seating riser assemblies 10 are straight, and a series of spaced apart assemblies 10 may be used with straight bridging panels 14 therebetween along a straight wall. A portion of such a series is seen in FIGS. 1 and 5. Alternatively, as will be appreciated by one of skill in the art, the bridging panels may be trapezoidal or pie-shaped to generate shapes to fill curved or corner portions of a seating system. Depending on the rise chosen between vertically spaced risers, hard closure panels 16 may be attached to each riser of assembly 10 to enhance the appearance and safety of the assembly 10. Complementary hard closure panels 18 may be attached to the spaced apart assemblies 10 to provide closures between deck bridging deck panels 14.

In a particularly advantageous method of using the invention, the deck bridging panels 14 may stay in place while moving extended portions of the seating system. Also, when using straight bridging panels, the panels may stay in place when moving from an extended position, as seen in FIG. 5, to a retracted position, as seen in FIG. 1, or vice versa. Or, if necessary, bridging panels 14 may be stacked atop a retracted telescopic seating riser assembly 10 and the retracted assemblies 10 may be moved adjacent each other to reduce the required storage space of the entire system.

Figure 2:
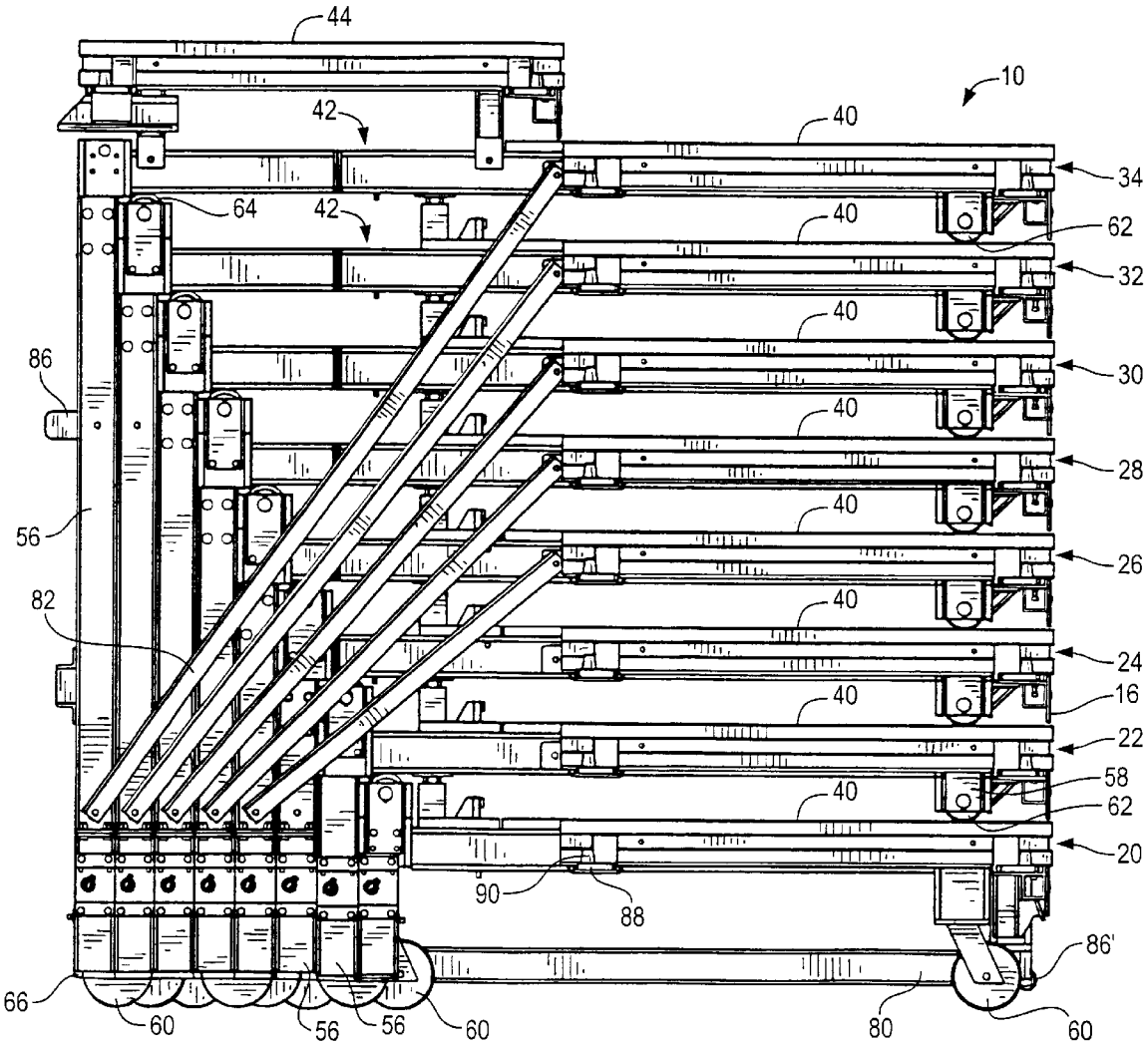
FIG. 2 is a side view of a retracted telescopic seating riser assembly.
Figure 3:
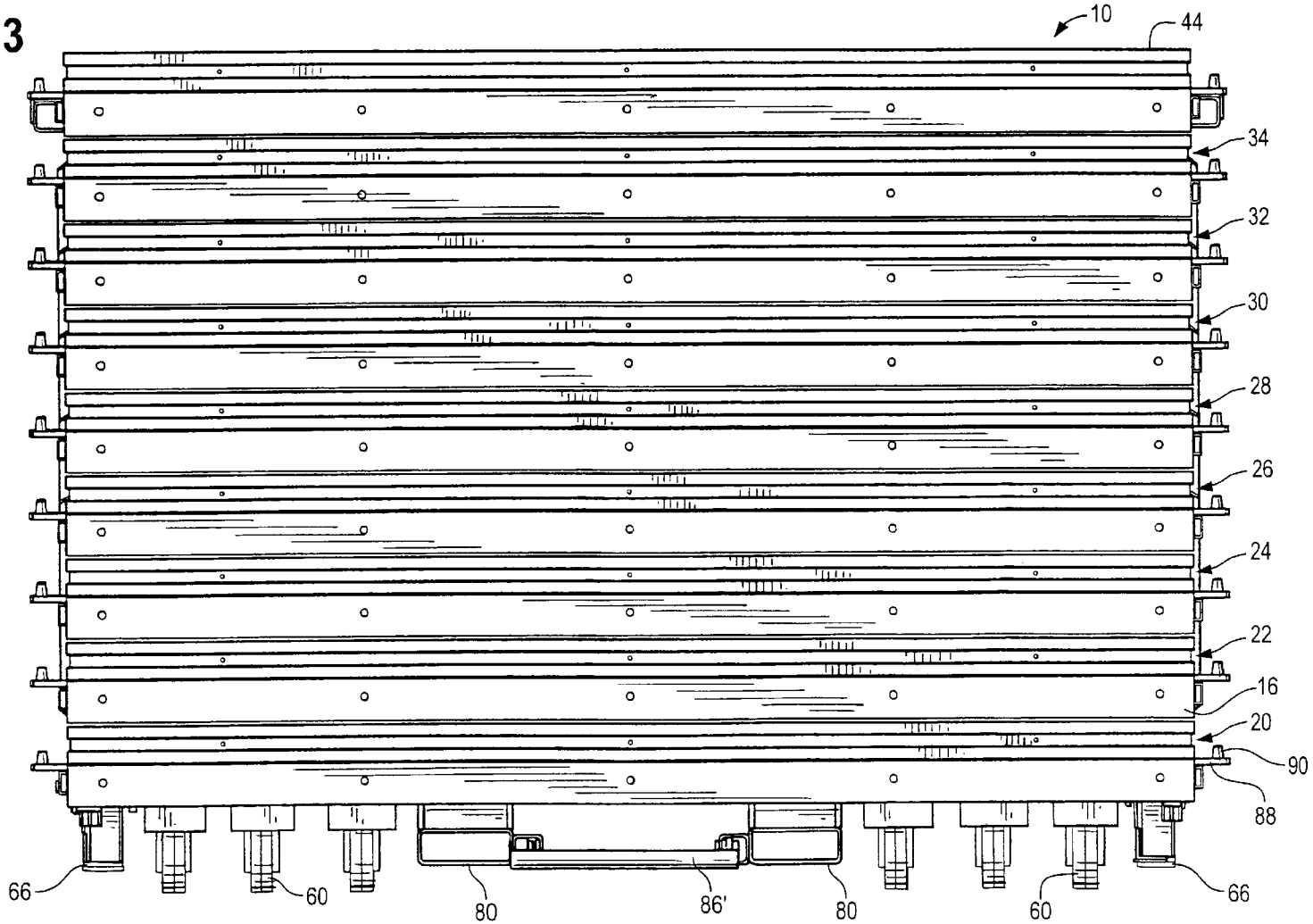
FIG. 3 is a front view of a retracted telescopic seating riser assembly.
Figure 4:
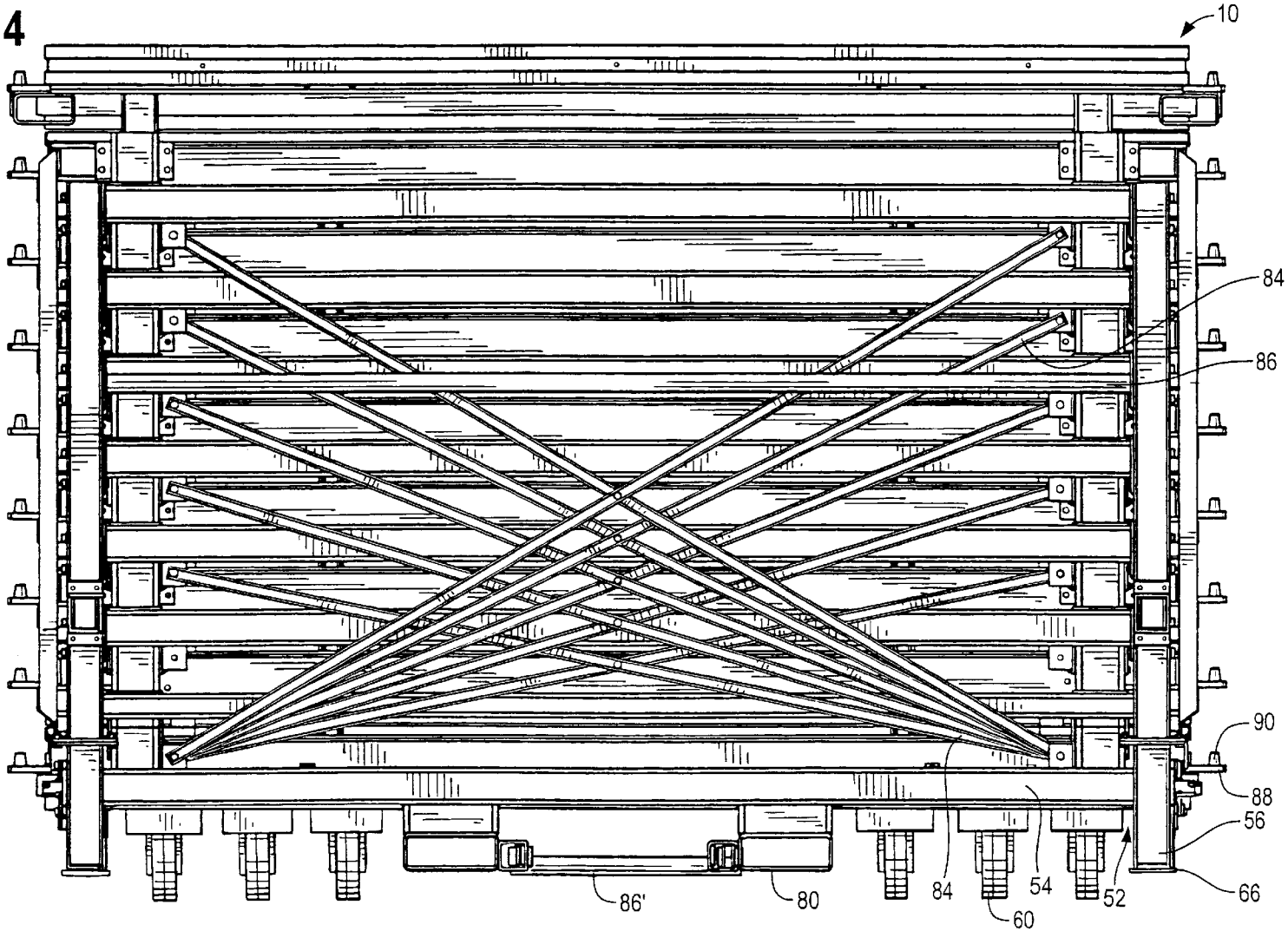
FIG. 4 is a rear view of a retracted telescopic seating riser assembly.
Figure 7:
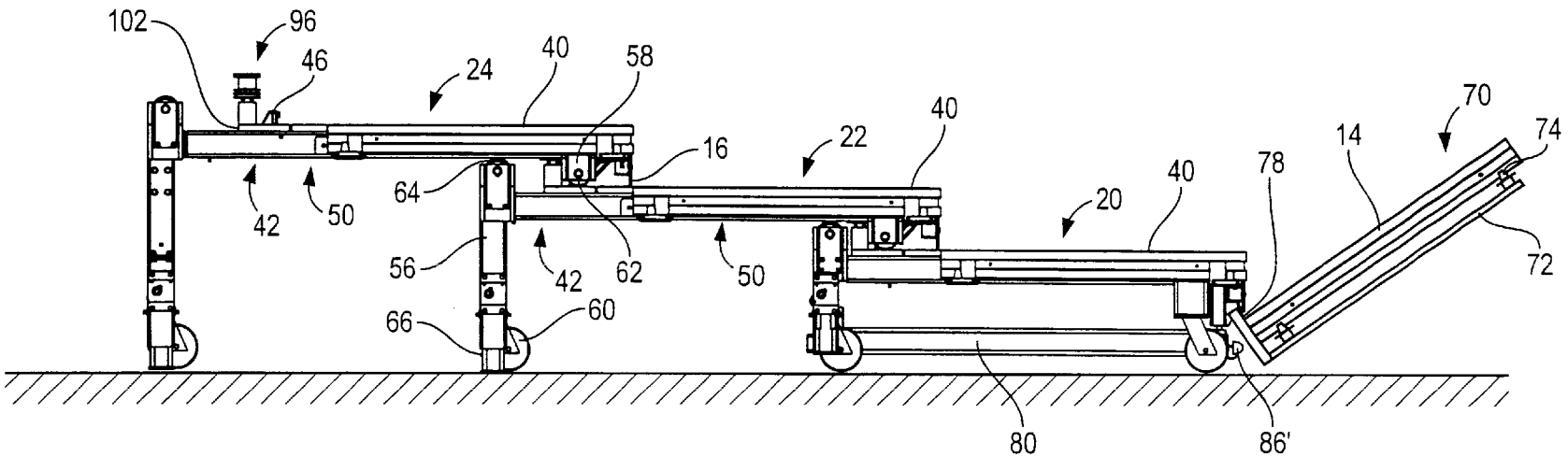
FIG. 7 is a side view of the three lowest elevated risers of an extended telescopic seating riser assembly in combination with a ground engaging deck panel assembly placed in position for installation.

Each assembly 10 of the embodiment shown includes a first elevated riser 20, and successive additional elevated risers 22, 24, 26, 28, 30, 32 and 34. It will be appreciated that the number of additional risers in any given assembly will be a matter of design requirements and safety. As best seen in FIGS. 2 and 7, each successive riser has a similarly sized forward deck 40 on a horizontal portion 42. Each riser horizontal portion 42 is longer than the next lower respective riser horizontal portion 42. The top riser 34 has a further elevated rearward deck panel 44. Each horizontal portion 42 preferably has a pair of upright projections 46 to provide a stop when each riser is fully extended for use.

Figure 9:
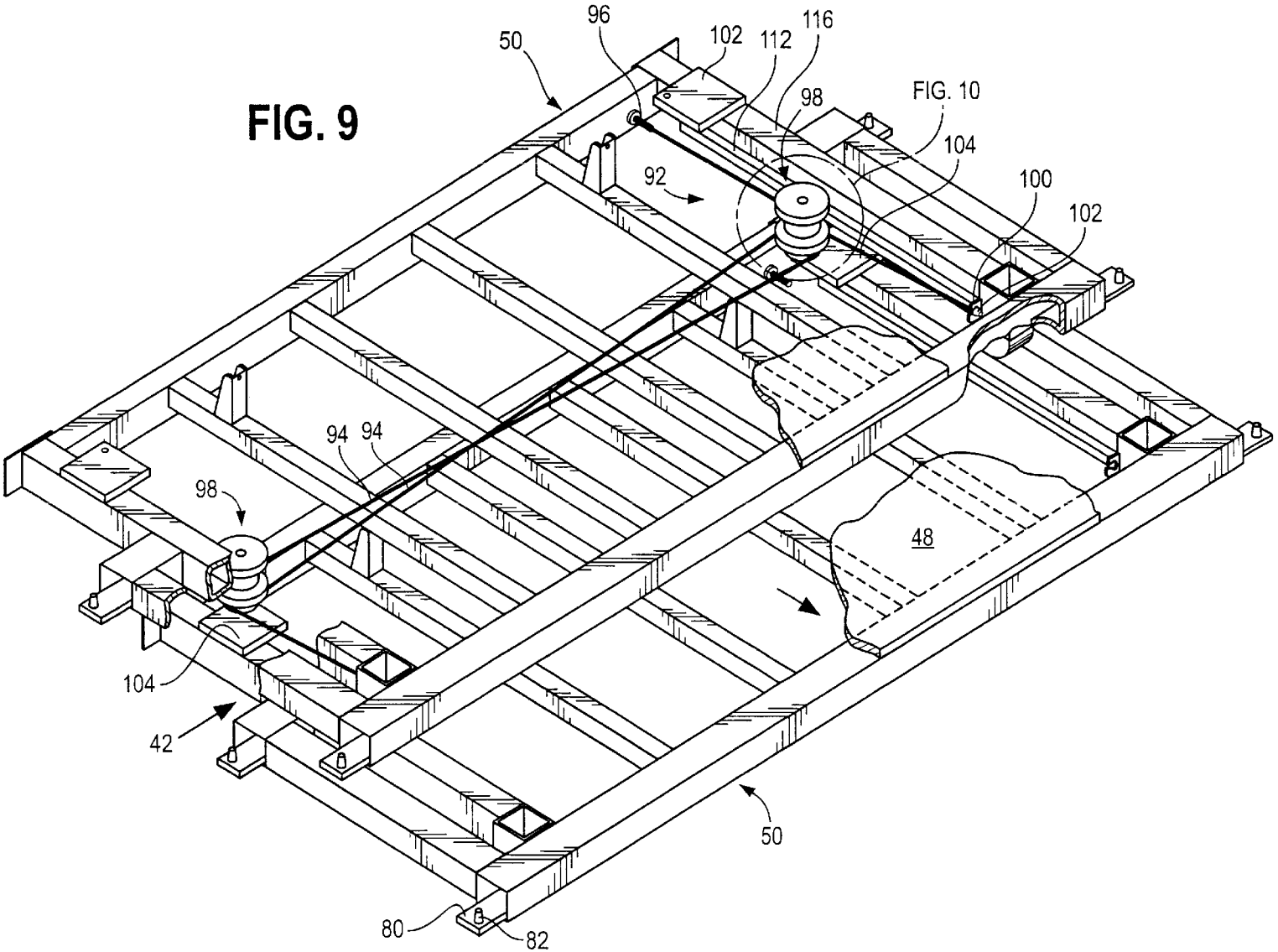
FIG. 9 is a side perspective view of a portion of the frame structure of two risers of a partially extended telescopic seating riser assembly.
Figure 11:
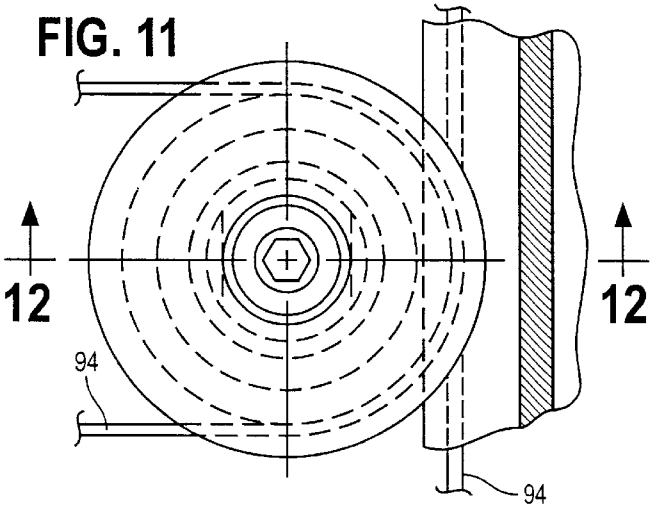
FIG. 11 is a top view of the pulley assembly and guide rail of FIG. 10.
Figure 12:
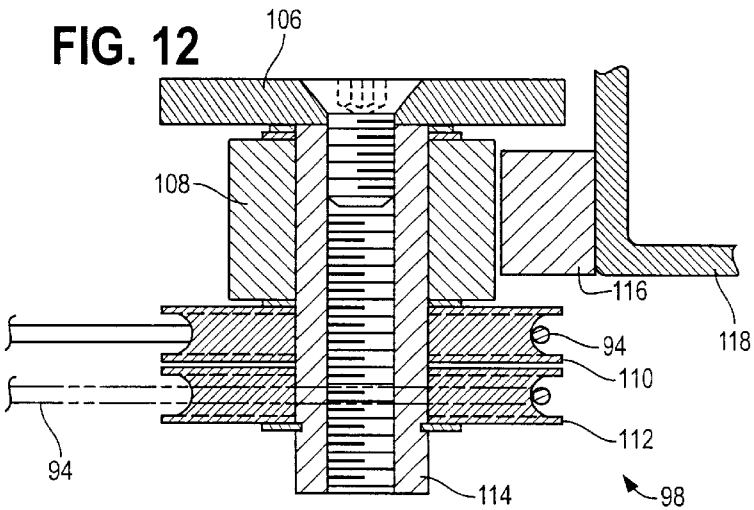
FIG. 12 is a partial cross sectional front view of the pulley assembly and guide rail of FIG. 10 in accordance with the section indicated in FIG. 11.
Figure 10:
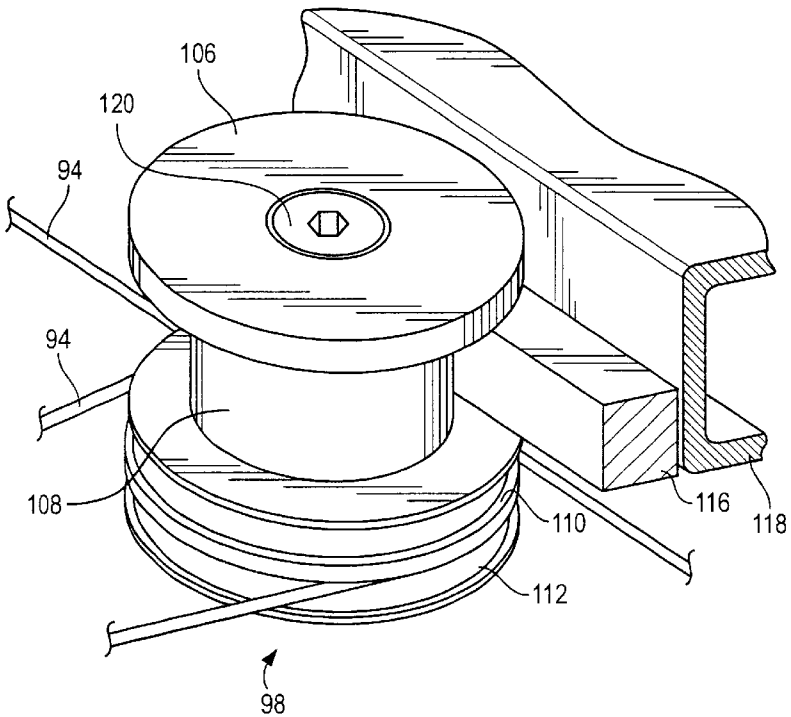
FIG. 10 is a side perspective view of a pulley assembly and guide rail as used in maintaining the alignment between two risers in a telescopic seating riser assembly.

As best seen in FIG. 7, in the present embodiment, the first elevated riser 20 rests on caster wheels 60 that are in direct contact with the floor surface, while each of the additional risers is supported at three respective locations. For instance, as seen in FIG. 9, each riser has a frame 50, and returning to FIG. 7, with respect to the third elevated riser 24, the frame has a rear leg assembly 52, including a cross beam 54 with caster wheels 60 and rear legs 56 to rest on the floor. Each riser also has front legs 58 with wheels 62 to rest on the deck of the next lower riser, as seen with respect to third elevated riser 24 resting on the next lower elevated riser 22. Supplemental support also is provided in the span between front legs 58 and rear legs 56, with each horizontal portion 14 of a riser resting atop a wheel 64 facing upward from a support on the rear leg assembly 52 of the next lower riser, again as seen with respect to the third elevated riser 24 and the rear leg assembly 52 of the second elevated riser 22. It will be appreciated that the height of any supports or legs is dependent on design choices including the desired rise between respective seating risers. In some cases, for instance, the front wheels may be located nearly entirely within a tube of frame 50, with no appreciable downward leg 58.

When an assembly 10 is located at the site where it will be used and stored, it may be moved in the retracted or extended state on caster wheels 60 on the rear leg assembly 52 and front legs 58 of first elevated riser 20, and on the caster wheels 60 on the rear leg assemblies 52 of the additional elevated risers. To enhance the system stability and load capacity for actual use as seating risers, each depending leg 56, 58 of an elevated riser may include an extendible foot 66 to accept direct, stationary loading. As shown in the preferred embodiment, for simplicity of assembly and use, it is desirable to have the feet 66 extend only from the rear legs of each elevated riser. Feet 66 are shown in a retracted position in FIGS. 1–4 and 7, and in an extended position in FIGS. 5 and 6.

Figure 8:
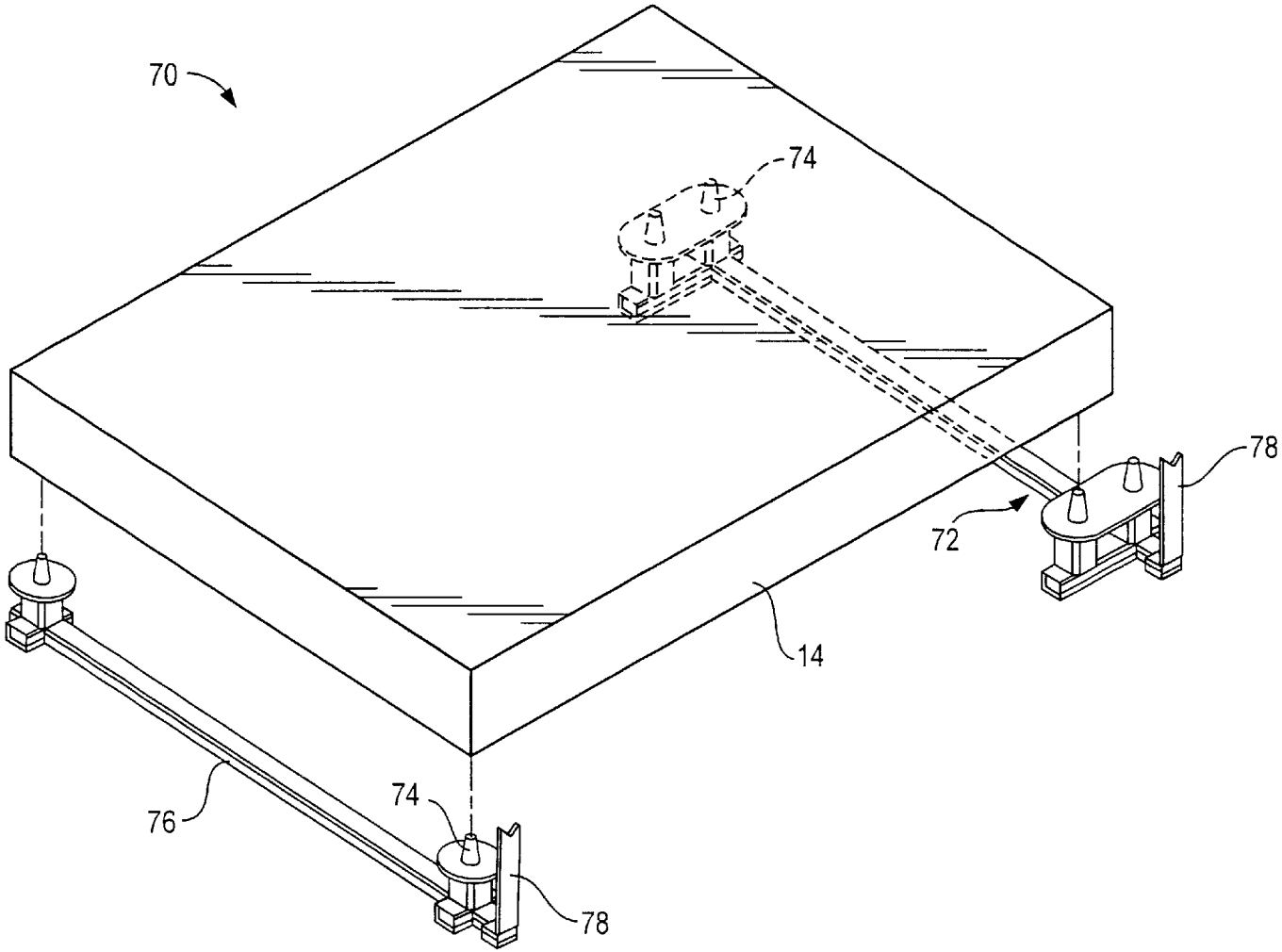
FIG. 8 is a perspective exploded view of a ground engaging deck panel assembly intended for use with a telescopic seating riser assembly having a bridging panel to only one side of the assembly.

To similarly lift the front of the first elevated riser 20 off of the caster wheels 60 on front legs 58, a floor engaging deck panel assembly 70 of FIG. 8 is used. The assembly 70 may be constructed by attaching pedestals to the bottom of a deck bridging panel 14. The choice of pedestals is determined by whether the telescopic seating riser assembly 10 will be flanked by bridging panels 14 on both sides such as in the center of a run within a seating system, or whether the assembly 10 will be required to support bridging panels 14 only on one side such as when positioned at the end of a run within a seating system, or whether the assembly 10 will stand alone without having to support bridging panels 14 on either side. Deck bridging panels 14 are provided with node receptacles proximate the panel corners in at least the lower surface of the panel to engage locator nodes. Hence, if deck bridging panels 14 will be adjacent a particular side, then a pedestal 72 having forward and rearward pairs of upward projecting locator nodes 74 will be required. Alternatively, on any side adjacent which deck panels 14 will not be used, a pedestal 76 having forward and rearward single upward projecting locator nodes 74 will be required. Both pedestals 72 and 76 have upstanding projections 78 at their rear. Once the appropriate choice of pedestals is made for a given deck panel assembly 70, the pedestals may be permanently attached to a deck bridging panel 14 by use of adhesives or mechanical fasteners. If the node receptacles in deck bridging panels 14 are essentially holes that extend completely through the panel, then the locator nodes 74 may be constructed to receive a fastener installed from the top surface of the panel To lift the front of the first elevated riser 20 off of the caster wheels 60, a deck panel assembly 70 is slid rearward into position at an angle to the floor surface, as seen in FIG. 7, by allowing the rearward edge of deck panel assembly 70 to rest on the floor while the forward edge is held above the floor surface. Once the upstanding projections 78 on deck panel assembly 70 are in position beneath the front of the first elevated riser 20, the forward edge of deck panel assembly 70 is lowered to the floor, which in turn causes the projections 78 to contact the underside of riser 20 and to lift the riser 20 and the caster wheels 60 on its front legs 58 off of the floor.

It will be appreciated that telescopic seating riser assemblies 10 may be constructed to be positioned adjacent each other in forward alignment to create seating systems having additional riser heights. In such systems, the height of the first elevated riser of the next rearward assembly should be greater than the tallest or last elevated riser of the next forward assembly. Also, such rearward assemblies would not use a floor engaging deck panel assembly 70, but rather would include forward depending legs, each having an extendible foot similar to those used with depending legs 56, to accept direct, stationary loading. In a similar manner, it will be appreciated that assemblies 10 may be constructed for use without a floor engaging deck panel assembly 70 in systems that simply require the forward most riser to be elevated some distance from the floor.

It also will be appreciated that a telescopic seating riser assembly 10 may be alternatively constructed with fixed legs in place of the wheels 60 shown, and that wheels 60 may instead be employed in place of feet 66. Such an assembly 10 would therefore be raised onto wheels 60 for movement across the floor when the legs are extended, and then set onto the fixed legs when the legs are retracted.

For ease of transporting a riser assembly 10 and for initial installation, the first elevated riser 20 may include tubes 80 to accept a fork lift or other lifting equipment. The compact storage of each successive elevated riser level immediately above the next lower elevated riser level facilitates the lifting of the entire assembly 10 by positioning the lift mechanism beneath the first elevated riser 10.

As shown in FIG. 9, to simplify manufacture and reduce weight, it is preferable to incorporate the frame 50 of each riser into the respective deck 40. A decking 48 may be mounted directly to the frame 50 as shown. Alternatively, deck panels similar to rearward deck panel 44 or deck bridging panels 14 may set on top of frame structures.

The use of deck bridging panels 14 significantly reduces the complexity and weight of the support structure needed for a given riser surface area. However, use of deck bridging panels 14 also requires that the risers be adequately stabilized and supported proximate their ends. In this regard, it will be appreciated that as a matter of design choice, gussets 82 are used with the taller elevated risers 26, 28, 30, 32 and 34. The gussets 82 are set at complementary angles for an aesthetically pleasing appearance and to avoid interference between risers. Similarly, the rear legs 56 of the respective risers are set proximate the riser ends and are arranged in forward alignment with each other in a nesting format. The risers are further stabilized by rear cross gussets 84. The rear cross gussets 84 are connected to horizontal portions 42 at their upper ends and are connected to the rear cross beams 54 at their lower ends. The rear cross gussets 84 also are positioned forward of a handle 86 for use in moving the telescoping seating assembly 10 across the floor. A handle 86' may be provided for convenience in extending or retracting the risers of assembly 10. Handle 86' preferably is constructed to extend forward of assembly 10 and rotate upward for use, and to retract to a position beneath the first elevated riser 20 for storage.

The use of deck bridging panels 14 between spaced apart telescopic seating riser assemblies 10 further requires that the risers be equipped proximate their ends with supports to accept the deck bridging panels 14. Accordingly, each riser of the telescopic seating riser assembly 10 preferably employs deck bridging panel supports 88 with upward projecting locator nodes 90. Locator nodes 90 are similar to previously mentioned locator nodes 74, and are similarly engaged by node receptacles on the lower surface of deck bridging panels 14 for use in a seating system as seen in FIGS. 1 and 5.

It is highly desirable to maintain proper forward alignment of the risers when extending and retracting a telescopic seating riser assembly 10. This is especially true when using deck bridging panels 14 which rely on proper placement of a pair of spaced apart risers assemblies 10 with deck bridging panel supports 88 and locator nodes 90. To reduce the effort and time required to move the telescopic seating riser assemblies 10 between a retracted position for storage and an extended position for use, the assemblies 10 employ a cable alignment systems 92 between each adjacent pair of vertically spaced risers, as seen in FIG. 9. The cable alignment system 92 is somewhat similar to the system used in prior art U.S. Pat. No. 3,400,502, but employs enhanced features.

Between each pair of vertically spaced risers, a cable system 92 employs a pair of cables 94, cable tension adjusters 96, pulley systems 98, and cable end holder flanges 100. Each cable 94 is preferably made of braided steel wire, with a terminating end plug 102, that is retained by a cable end holder flange 100 proximate the front of frame 50. The cable tension may be adjusted from the rear of the assembly by use of the tension adjuster 96, which employs a nut and a threaded adjuster bolt attached to the other terminating end of the cable 94, proximate the rear of frame 50. Each pair of cables 94 is then strung in opposite manner around a pair of pulley systems 98, as best seen in FIGS. 9–12. This opposed relationship causes the pulleys to move directly forward and rearward as an assembly 10 is extended or retracted.

The pulley systems 98 are rotatably connected to a mounting plate 104. Pulley systems 98 have a retainer top 106, a roller 108, an upper pulley 110, a lower pulley 112 and a pedestal 114. As will be appreciated by one of skill in the art, the components are separated by thin bushings to facilitate the rotation of the roller 108, upper pulley 110 and lower pulley 112 relative to one another and to the pedestal 114 which acts as a common axle for these components. The frame 50 employs a guide 116 along the inside of each of the side frame members 118. Guides 116 assist in maintaining side to side, or lateral alignment by riding against or staying between rollers 108. Guides 116 also ensure that each riser assembly maintains vertical alignment to prevent inadvertent lifting upward of a riser which could otherwise derail the cables. This vertical alignment is achieved by each guide 116 being located between an upper pulley 110 and a retainer top 106. A fastener 120 holds the retainer top 106 on pedestal 114, which is, in turn, fastened to mounting plate 104.

It will be appreciated that telescopic seating riser assembly 10 is a load bearing structure intended to hold many people and equipment, such as portable seating, above a floor surface. Therefore, assembly 10 should be suitably constructed. For instance, the structural members of the riser assembly 10 preferably are constructed of thin wall tubing, straight bar stock, right angle bar stock, and plate of suitable materials, for instance, steel, alloy, aluminum, wood or high strength plastics. Components may be joined in any number of conventional manners, such as by welding, gluing or with suitable fasteners. Wheels 60 are preferably of the swivel caster type. If extendible feet 66 are used in conjunction with fixed height wheels 60, or if fixed legs are used in conjunction with wheels 60 on extendible feet, then the wheels 60 may be designed with a reduced load capacity. For instance, the wheels 60 could be capable of carrying only the weight of the telescopic seating riser assembly 10, or might be designed to be capable of supporting the assembly 10 with additional deck bridging panels 14 and floor engaging deck panel 16 for storage. It will be appreciated that in reference to the wheels 62 and 64, such wheels may be constructed of any device that provides rolling or other relative movement, such as sliding, between respective surfaces.

It also should be understood that while a preferred embodiment has been described herein, any of a variety of fastening means and suitable materials of construction and dimensions may be used to satisfy the particular needs and requirements of the end user. It will be apparent to those skilled in the art that various modifications and variations can be made in the design and construction of a telescopic seating riser assembly without departing from the scope or spirit of the present invention. Other embodiments of the invention will be apparent to those skilled in the art from consideration of the specification and practice of the invention disclosed herein.

What is claimed is:

1. A telescopic seating riser assembly comprising a plurality of risers having vertically spaced substantially horizontal portions, said risers movable between at least an extended position for use and a retracted position for storage, said assembly further comprising:

each riser having at least a first rear leg proximate a first rear corner of the riser and at least a second rear leg proximate a second rear corner of the riser wherein in the retracted position the first rear leg of each riser is in substantial forward alignment with the first rear leg of the other risers and the second rear leg of each riser is in substantial forward alignment with the second rear leg of the other risers;

each riser above a lowest riser further having at least a first front wheel proximate a first front corner of the riser and at least a second front wheel proximate a second front corner of the riser, said front wheels contacting an upper surface of a next lower riser; and each riser having deck bridging panel supports, said deck bridging panel supports adapted to engage a deck bridging panel when a pair of riser assemblies are spaced apart substantially the length of the deck bridging panel.

2. A telescopic seating riser assembly in accordance with claim 1, wherein each riser below an upper most riser has at least a pair of upward facing wheels in engagement with an underside surface of a next higher riser.

3. A telescopic seating riser assembly in accordance with claim 1, wherein at least one riser further comprises a gusset connected at a first end to said first rear leg and connected at a second end to said riser at a location between said first front corner and said first rear corner.

4. A telescopic seating riser assembly in accordance with claim 1, wherein each adjacent vertically spaced pair of risers comprises an upper riser and a lower riser, said pair of risers further comprising a cable and pulley alignment system having a pair of cables connected at their ends to the upper riser and a pair of pulleys rotatably connected to the lower riser.

5. A telescopic seating riser assembly in accordance with claim 4, wherein one cable is connected at a first end proximate said first rear corner of said upper riser and is connected at a second end proximate said second front corner of said upper riser, and said second cable is connected at a first end proximate said second rear corner of said upper riser and is connected at a second end proximate said first front corner of said upper riser.

6. A telescopic seating riser assembly in accordance with claim 1, wherein the first front corner and the first rear corner are spaced apart a different distance for each riser.

7. A telescopic seating riser assembly comprising a plurality of risers having vertically spaced substantially horizontal portions, said risers being movable between at least an extended position for use and a retracted position for storage, wherein each riser further comprises:

at least one upward facing deck surface on said horizontal portion;

at least one pair of rear legs wherein in the retracted position said at least one pair of rear legs of each riser are in substantial forward alignment with said at least one pair of rear legs of each other riser;

at least one pair of ground engaging wheels proximate said rear legs; and at least one deck bridging panel support extending outward from said horizontal portion of said riser.

8. A telescopic seating riser assembly in accordance with claim 7, wherein each riser below an upper most riser has at least a pair of upward facing wheels in engagement with an underside surface of said horizontal portion of a next higher riser.

9. A telescopic seating riser assembly in accordance with claim 7, wherein at least one riser further comprises at least one gusset connected at a first end to a rear leg and connected at a second end to said horizontal portion.

10. A telescopic seating riser assembly in accordance with claim 7, wherein a first rear leg of each said pair of rear legs is located proximate a first rear corner of the riser and a second rear leg of each said pair of rear legs is located proximate a second rear corner of the riser.

11. A telescopic seating riser assembly in accordance with claim 7, wherein each riser above a lowest riser further comprises at least a pair of front wheels in engagement with the upward facing deck surface of a next lower riser.

12. A telescopic seating riser assembly in accordance with claim 7, wherein opposed said deck bridging panel supports of a pair of riser assemblies spaced apart substantially the length of a deck budging panel are adapted to engage the deck bridging panel.

13. A method of providing support for deck bridging panels in a telescopic seating riser assembly, comprising the steps of:

providing a pair of spaced apart telescopic seating riser assemblies, each assembly comprising a plurality of risers having vertically spaced substantially horizontal portions, said risers movable between at least an extended position for use and a retracted position for storage, wherein each riser further comprises at least one upward facing deck surface on the horizontal portion and at least one deck bridging panel support extending outward from the horizontal portion; and supporting at least one deck bridging panel by said deck bridging panel supports on said pair of spaced apart telescopic seating riser assemblies in an extended position for use and in a retracted position for storage of said assemblies.

14. The method of claim 13, wherein each riser below an upper most riser has at least a pair of upward facing wheels in engagement with an underside surface of said horizontal portion of a next higher riser.

15. The method of claim 13, wherein each telescopic seating riser assembly further comprises at least one pair of rear legs.

16. The method of claim 15, wherein said rear legs of each riser are in substantial forward alignment with said rearward legs of each other riser.

17. The method of claim 15, wherein at least one riser further comprises at least one gusset connected at a first end to a rear leg and connected at a second end to said horizontal portion.

18. The method of claim 15, wherein at least one riser further comprises at least one pair of ground engaging wheels proximate said rear legs.

19. A telescopic seating riser assembly comprising a plurality of risers having vertically spaced substantially horizontal portions, said risers being movable between at least an extended position for use and a retracted position for storage, wherein each riser further comprises:

at least one upward facing deck surface on said horizontal portion;

at least one pair of rear legs wherein in the retracted position said at least one pair of rear legs of each riser are in substantial forward alignment with said at least one pair of rear legs of each other riser;

each riser having front and rear corners;

wherein for each riser each front corner is spaced apart from each rear corner a different distance than for each other riser; and wherein each riser further comprises at least one deck bridging panel support extending outward from said horizontal portion of said riser.

20. A telescopic seating riser assembly in accordance with claim 19, wherein each riser below an upper most riser has at least a pair of upward facing wheels in engagement with an underside of said horizontal portion of a next higher riser.

21. A telescopic seating riser assembly in accordance with claim 19, wherein at least one riser further comprises at least one gusset connected at a first end to a rear leg and connected at a second end to said horizontal portion.

22. A telescopic seating riser assembly in accordance with claim 19, wherein a first rear leg of each said pair of rear legs is located proximate a first rear corner of the riser and a second rear leg of each said pair of rear legs is located proximate a second rear corner of the riser.

23. A telescopic seating riser assembly in accordance with claim 19, wherein each riser above a lowest riser further comprises at least a pair of front wheels in engagement with the upward facing deck surface of a next lower riser.

24. A telescopic seating riser assembly in accordance with claim 19, wherein said at least one deck bridging panel support further comprises at least one deck bridging panel support proximate front corners of each riser and at least one deck bridging panel support proximate rear corners of said upward facing deck surface on each riser.

25. A telescopic seating riser assembly in accordance with claim 24, wherein opposed said deck bridging panel supports of a pair of riser assemblies spaced apart substantially length of a deck bridging panel are adapted to engage the deck bridging panel.

* * * * *